United States Patent [19]

Magers

[11] Patent Number: 4,643,692

[45] Date of Patent: Feb. 17, 1987

[54] DOMED SPINNING TOP

[76] Inventor: Ronald G. Magers, 79 Eastern Ave., Essex, Mass. 01929

[21] Appl. No.: 778,528

[22] Filed: Sep. 20, 1985

[51] Int. Cl.[4] ..... A63H 1/06; A63H 1/00; A63H 13/20

[52] U.S. Cl. ..... 446/259; 446/236; 272/31 R

[58] Field of Search ..... 446/236, 256, 259, 238, 446/249, 262, 264, 266; 272/28 R, 28 S, 31 R, 31 P, 39, 42, 43

[56] References Cited

U.S. PATENT DOCUMENTS

| | | | |
|---|---|---|---|
| 102,244 | 4/1870 | Franke | 446/256 |
| 407,521 | 7/1889 | Fischer | 446/262 X |
| 532,678 | 1/1895 | Martin | 446/264 X |
| 931,487 | 8/1909 | Reed | 446/260 |
| 1,158,352 | 10/1915 | Williams | 446/259 |
| 1,783,627 | 12/1930 | Raimondi | 446/256 |
| 2,457,447 | 12/1948 | Cohn | 272/31 R |
| 2,544,594 | 3/1951 | Goldfarb | 272/31 R |
| 2,569,922 | 10/1951 | Centofanti | 272/31 R |
| 3,103,362 | 9/1963 | Elofson | 272/31 R |
| 3,163,426 | 12/1964 | Ruderian | 446/260 |
| 3,279,793 | 10/1966 | Lakin | 272/31 R |
| 3,898,762 | 8/1975 | Balleis | 446/259 |
| 4,233,774 | 11/1980 | Sahar | 446/256 |
| 4,355,481 | 10/1982 | Joslyn | 446/265 |
| 4,467,554 | 8/1984 | Russell | 446/260 |

FOREIGN PATENT DOCUMENTS

| | | | |
|---|---|---|---|
| 444352 | 3/1936 | United Kingdom | 446/259 |

*Primary Examiner*—Robert A. Hafer
*Assistant Examiner*—D. N. Muir
*Attorney, Agent, or Firm*—Neuman, Williams, Anderson & Olson

[57] ABSTRACT

A domed spinning top is disclosed in which a vertically movable housing member having a transparent dome is mounted above a stationary base. A rotatable turntable is mounted on the housing member under the dome. An actuating mechanism acts upon a drive mechanism to engage the turntable and rotate it during vertical movement of the housing member toward the base. Upon cessation of vertical movement of the housing member toward the base, the actuating mechanism disengages the drive mechanism from the turntable to permit the turntable to rotate freely. A peek-a-boo enclosure comprising a plurality of shroud segments is mounted on the turntable in which the segments separate to expose a central figure during rapid rotation of the turntable, and return together to substantially encase the central figure when rotation of the turntable is diminished.

9 Claims, 6 Drawing Figures

FIG. 1A
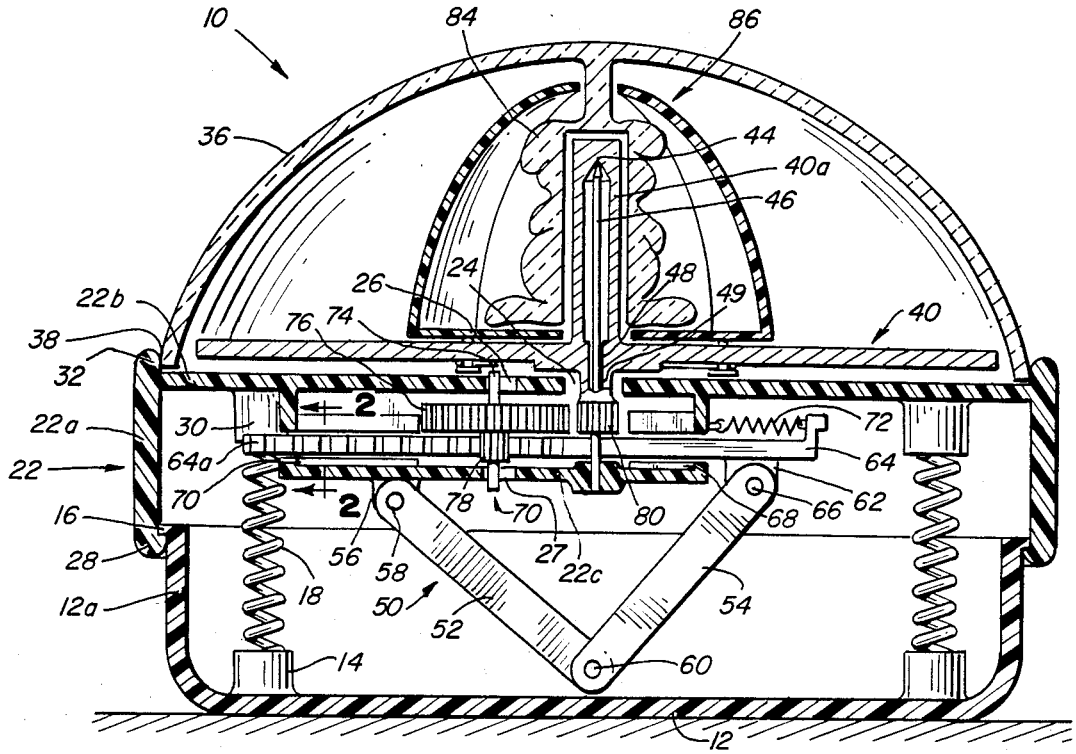
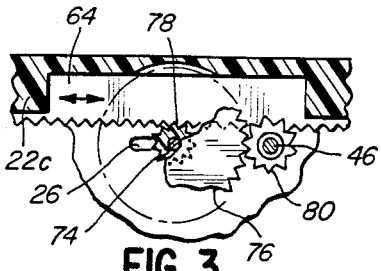
FIG. 3
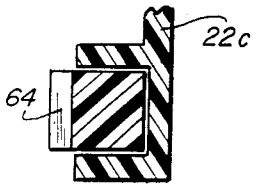
FIG. 2
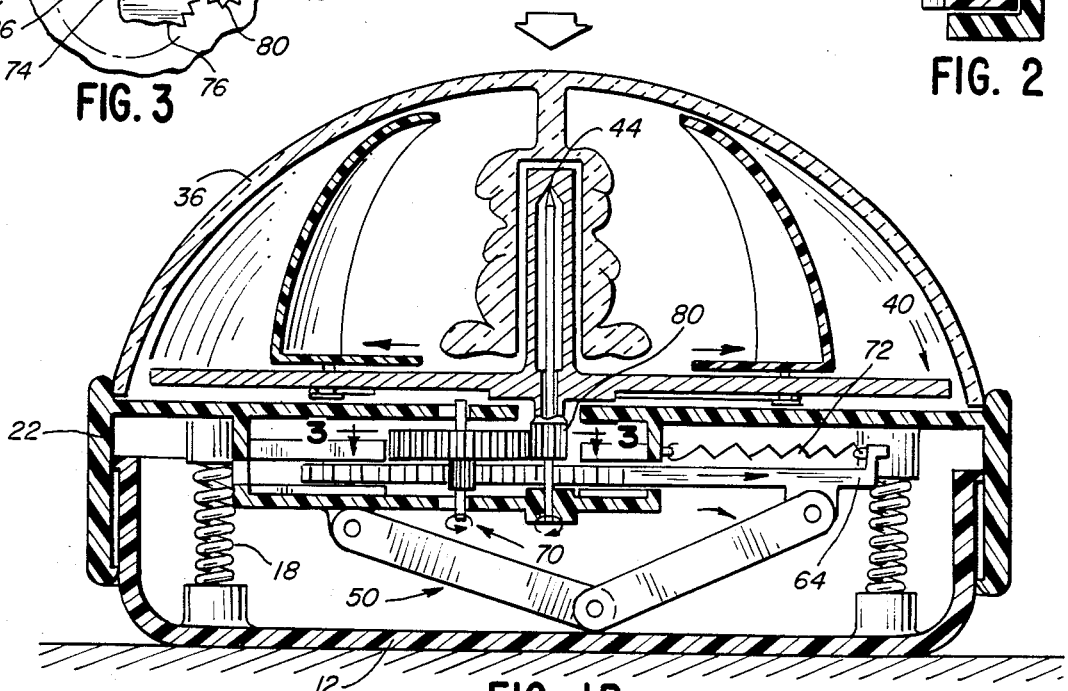
FIG. 1B

DOMED SPINNING TOP

BACKGROUND OF THE INVENTION

1. Field of the Invention

This invention relates generally to a toy spinning top, and pertains more specifically to a toy top having a stationary base and a vertically movable housing with a transparent dome in which a rotatable turntable carrying a visual display is mounted. In the preferred embodiment, simple downward pressure applied to the dome or movable housing of the top will actuate a drive mechanism through an actuating mechanism to rotate a turntable under the dome. When downward travel of the dome ends, the activating mechanism disengages the drive mechanism from the turntable to permit the turntable to rotate freely.

The toy top of the present invention also includes a "peek-a-boo" feature comprising a plurality of segments mounted on the turntable that fit together to form a shroud to substantially encase a central figure. As the turntable rotates in response to downward pressure on the dome or housing, the shroud segments are displaced radially outwardly by centrifugal force to expose the central figure. As centrifugal force from the rotating turntable is diminished, the shroud segments return radially inwardly to once again encase the central figure.

2. Description of the Prior Art

Infants and toddlers prefer toys that are visually stimulating, but most do not possess the manual dexterity necessary to operate most mechanical toys. In the past, various toy spinning tops have been devised for use by children. However, most of these spinning tops require substantial manual skill and hand-eye coordination to operate. Conventional spinning tops, for example, often employ reciprocating plungers for producing rotation of a spinner. Some conventional tops employ internal coil springs that are wound up by hand and released to induce rotation of a spinner. To operate these conventional tops, a child must possess a substantial degree of manual acuity since reciprocating plungers are often small in size and require special actuating movements, while tops with internal coil springs require difficult manipulations of the housings of the tops to wind the coil springs. Orienting the top in its operative position requires additional skill.

A conventional top is depicted in Joslyn U.S. Pat. No. 4,355,481 that uses a reciprocating plunger to actuate a driver which in turn rotates a turntable. Ruderian U.S. Pat. No. 3,163,426 discloses a gear mechanism for rotating a spinner which is actuated by inward movement of a small lever. A conventional domed top is depicted in Balleis U.S. Pat. No. 3,898,762 wherein the top is actuated by depressing a plunger-type twist knob which transmits rotary movement to the spinner. However, operation of these tops requires substantial manual dexterity since the plungers or actuating levers must be grasped and held firmly while being depressed. These tops are therefore not particularly well suited for infants and toddlers with limited manual abilities. Another drawback of these tops is that several moving or rotating parts are exposed. Consequently, there is a possibility that small fingers may become pinched between moving parts or scraped by a sharp edge during operation.

Tops actuated by internal coil springs are depicted in Reed U.S. Pat. No. 931,487 and Russell U.S. Pat. No. 4,467,554. To wind the coil spring in the Reed top, one hand of the operator must grasp the fan member while the other hand rotates a wrench attached to the square portion of the spindle. In the Russell spinning toy, the toy is wound by the operator holding the lower assembly with one hand and revolving the upper assembly with the other hand, using short rods projecting from the upper surface of the toy as crank pins to put tension on the coil spring. Thus, actuation of the Reed and Russell tops also requires complex mechanical manipulations that infants and small children with undeveloped motor skills may be unable to accomplish.

The present invention is directed to overcoming these and other difficulties inherent in the prior art. In the present invention, a domed spinning top is provided in which simple downward pressure is applied to the dome or movable housing of the top to engage an actuating mechanism to operate a drive mechanism that rotates a turntable under the dome at a rapid speed to provide a stimulating visual display. The present invention accomplishes these goals through a simple mechanism adapted for high speed, low cost manufacture.

OBJECTS OF THE INVENTION

An object of the invention is to provide a toy top that is particularly suitable for infants and children of very tender age having limited manual dexterity.

Another object is to provide a spinning top having a minimum number of moving external parts exposed to prevent possible injury during use.

Still another object of the invention is to provide a mechanical spinning top that is maintained in a fixed position as the turntable rotates.

A further object of the invention is to provide a toy mechanical spinning top that is simple to operate and requires manipulation of relatively few mechanical parts.

Yet another object of the invention is to provide a toy mechanical spinning top that incorporates a minimum number of moving parts so that the toy will withstand rough usage by young children and will be relatively inexpensive to fabricate.

Still further, an object of this invention is to provide a toy that will be intriguing because of the particular movements derivable by merely applying manual pressure to the dome or housing of the top.

Further and additional objects will appear from the description, accompanying drawings and appended claims.

SUMMARY OF THE INVENTION

The above and other objects are accomplished in accordance with this invention by providing a domed spinning top having a vertically movable housing means with a transparent dome means in which a turntable means is mounted. An actuating means is engagable upon downward movement of the housing means and operates a turntable drive mechanism in response to simple downward movement of the housing. The actuating means causes the drive mechanism to disengage from the turntable to permit the turntable to rotate freely when downward movement of the housing ceases. The base of the top remains fixed on a horizontal surface while the turntable carrying a visual display rotates in relation thereto.

In the preferred embodiment, a stationary base member supports the top on a horizontal surface. A vertically movable housing member is mounted above the base. The housing member has a diaphanous dome attached to its upper portion. That is, the dome may be transparent or translucent, or even partially opague. Resilient compressive means such as springs urge the housing member in a vertical direction away from the base. A rotatable turntable is axially mounted on the housing member. A drive mechanism is provided for engaging the turntable to impart rotation thereto in response to dynamic operation of an actuating means. The actuating means acts upon portions of the drive mechanism to provide driving engagement with the turntable to rotate the turntable during vertical movement of the housing member toward the base. In the absence of vertical movement of the housing member toward the base, the actuating mechanisim acts to disengage the drive mechanism from the turntable to permit the turntable to rotate freely.

BRIEF DESCRIPTION OF THE DRAWINGS

FIG. 1A is a sectional view of a domed spinning top exemplifying the invention in its rest position.

FIG. 1B is a sectional view of the domed spinning top of FIG. 1A illustrating how the actuating and drive mechanisms respond to downward vertical pressure on the dome or movable housing.

FIG. 2 is an enlarged sectional view of a portion of FIG. 1A, taken in the direction of arrows 2—2 in FIG. 1A, showing in cross-section the mounting of the rack in a channel formed in the housing member.

FIG. 3 is an enlarged top view, partially in section, taken in the direction of arrows 3—3 of FIG. 1B and illustrating how the escape gear responds to lateral movement of the rack member.

DETAILED DESCRIPTION OF THE PREFERRED EMBODIMENT

Figure 4:
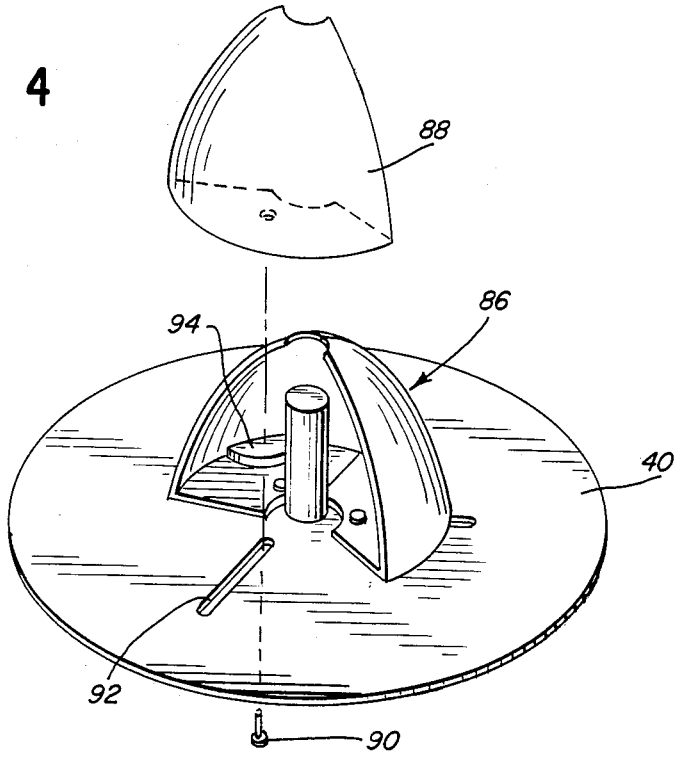
FIG. 4 is an exploded perspective view of the turntable assembly shown in FIG. 1A, illustrating the turntable with radial guide slots, shroud segments and fastening pin.

Turning now to the drawings and principally FIG. 1A, a domed spinning top constructed in accordance with the invention is denoted generally by the reference numeral 10. Domed spinning top 10 comprises a stationary base 12 for supporting top 10 on a horizontal surface such as a table top or a floor surface. Base 12 is shown as being generally bowl-shaped in configuration with an upwardly extending cylindrical wall 12*a*. The shape of base 12 is not critical and may for example be square or even octagonal in cross-section. In fact, with a non-round shape the need for any keying of the base 12 and housing 22 to prevent relative rotation is eliminated. A lip 16 extends outwardly around the upper portion of cylindrical wall 12*a*.

As shown in FIG. 1A, a plurality of bosses 14 project upwardly from the bottom inside surface of base 12. Bosses 14 may be formed integrally with base 12, or molded separately and then glued or fastened into place. The hollowed portions of bosses 14 house the lower ends of resilient compressive means, shown in FIG. 1A as compression springs 18.

Mounted above base 12 for vertical movement with respect to base 12 is a housing member 22. In the embodiment illustrated in FIG. 1A, housing member 22 is supported above base 12 by springs 18. Housing member 22 is shaped to conform to the shape of base 12, and is dimensioned to overlie lip 16 of base 12. In the present instance, housing member 22 comprises a cylindrical wall 22*a*, an integral disc 22*b* and an integral drive mechanism frame 22*c*. Cylindrical wall 22*a* is provided with a plurality of integral, inwardly projecting, circumferentially spaced tabs 28 which cooperate with lip 16 to retain housing member 22 in an overlying position above base 12. Disc 22*b* is formed with a central bore 24 to support the turntable hub and a longitudinal slot 26 for mounting the shaft of escape gear 70 of the drive means, as will be discussed in greater detail below. Disc 22*b* is provided with a plurality of downwardly projecting bosses 30 which correspond in alignment with bosses 14 in base 12. The hollowed portions of bosses 30 receive the upper ends of resilient compressive means, shown in FIG. 1A as compression springs 18.

In order to support housing member 22 for vertical movement above base 12, resilient compressive means are provided, shown in FIG. 1A as compression springs 18. Other means besides compression springs can be used, such as hydraulic or pneumatic mechanisms or spring and lever combinations, for example, to urge housing member 22 in a vertical direction away from base 12. In the present instance, compression springs 18 are mounted in bosses 14 and 30, respectively, of housing member 22 and base 12. In this configuration, compression springs 18 will resist downward pressure and rotational forces placed upon housing member 22.

Drive mechanism frame 22*c* depends downwardly from housing member 22. As illustrated in FIG. 1A, frame 22*c* has two side walls and a rear wall extending downwardly from disc 22*b*. The side walls of frame 22*c* each have a hole 68 and 70 for guiding inward and outward lateral movement of rack member 64. The rear wall of frame 22*c* has a channel formed therein also for guiding inward and outward lateral movement of rack 64. Frame 22*c* is also provided with a bottom plate having a longitudinal slot 27 for mounting the shaft 74 of escape gear 70. Slot 27 corresponds in alignment with slot 26. A support bracket 56 depends downwardly from the bottom plate of frame 22*c*.

A non-rotating axle 46 is rigidly secured in a boss in the bottom plate of frame 22*c*, as shown in FIG. 1A. Axle 46 extends upwardly from the bottom plate of frame 22*c* and is perpendicular thereto, passing through the central bore 24 of housing member 22. Axle 46 is formed with a top point 44, which serves as a needle-like bearing to support a turntable 40 for rotation.

Mounted on the upper surface of housing member 22 is a transparent dome 36. Dome 36 rests on the upper surface of housing member 22, and is provided with a plurality of circumferentially spaced tabs 38 formed integrally along its bottom edge. Tabs 38 project outwardly from dome 36 and are disposed in complementary slots 32 in cylindrical wall 22*a*. In assembled form, tabs 38 fixedly retain dome 36 in housing member 22. The dome may also be secured in place with an appropriate adhesive.

Turntable 40 is mounted for rotation above housing member 22, as shown in FIG. 1A. Turntable 40 should be provided with substantial mass to provide inertia and prolonged spinning once rotation is initiated. Turntable 40 is formed with an upwardly extending hub 40*a*. A trunnion 48 formed at the bottom of hub 40*a* provides a support bearing for turntable 40 around axle 46. A hollow central shaft 49 projects downwardly from turntable 40. In the illustrated embodiment, drive gear 80 is formed integrally at the lower end of shaft 49. In this configuration, drive gear 80 has a central bore through which axle 46 passes.

Turntable 40 can be decorated in any appropriate way to provide an interesting visual display during rotation of turntable 40. For example, turntable 40 can be decorated with animals, figures, kaleidoscopic designs or the like. In addition to a visual display, turntable 40 can be provided with an audio mechanism for imparting a musical sound as the turntable rotates.

To drive the turntable, vertical motion of the housing 22 is first converted into lateral transverse motion of rack member 64, which is in turn converted into rotary motion of turntable 40. In order to transform vertical motion of the housing into lateral motion of rack member 64, an elbow drive 50 is provided as shown in FIG. 1A. Elbow drive 50 comprises a first lever arm 52 and a second lever arm 54. First lever arm 52 is pivotally fastened at its upper end to support bracket 56 of housing member 22. In the illustrated form, first lever arm 52 is fastened to bracket 56 by pins or rivets 58. The lower end of first lever arm 52 rests on the inside surface of base 12. Second lever arm 54 is pivotally fastened at its lower end to the lower end of first lever arm 52 at central pivot 60. The upper end of second lever arm 54 is pivotally fastened to a support bracket 62 on rack member 64 which is confined to lateral, generally radial, movement in frame 22*c* of housing member 22. With this configuration, downward vertical movement of housing member 22 toward base 12 will cause elbow drive arms 52 and 54 to straighten, driving rack member 64 to the right from the position shown in FIG. 1A toward the position shown in FIG. 1B.

Bracket 62 of rack member 64 is pivotally fastened to the upper end of second lever arm 54 by rivet or pin 66. Rack member 64 is slidably mounted in a channel formed in the rear wall of frame 22*c*, as shown in FIG. 2. In addition, rack member 64 is retained for lateral movement in guide holes 68 and 70 formed in the side walls of frame 22*c*. Rack member 64 has a plurality of ratchet teeth 64*a*, shown as being on the left side of rack member 64 in FIG. 1A.

In order to return rack member 64 to its rest position after actuation of elbow drive 50, a return spring 72 is provided as shown in FIG. 1A. One end of return spring 72 is fastened to housing member 22. The other end of return spring 72 is fastened to rack member 64. Spring 72 urges rack member 64 toward a rest position which is shown as being to the left in FIG. 1A. Other equivalent means could be substituted for return spring 72 for the purpose of retracting rack member 64 after actuation. For example, a return spring could be fastened at one end to base 12 and at the other end to second lever arm 54. Another equivalent means would be a resilient mechanism for urging the center pivot 60 of elbow drive 50 downwardly toward a normally cocked position.

In order to convert lateral motion of rack member 64 into rotary motion to drive turntable 40, an escape gear 70 is provided as shown in FIG. 1A. Escape gear 70 comprises a shaft 74 and two concentric gears 76 and 78 mounted in stacked relationship on shaft 74. Escape gear 70 is carried in a pair of longitudinal slots 26 and 27 in housing member 22.

As shown in FIG. 3, slots 26 and 27 for mounting escape gear 70 are positioned so that pinion gear 78 remains constantly in mesh with the teeth 64*a* of rack member 64. The longitudinal dimension of slots 26 and 27 is set so that gear 76, at its rightmost position in FIG. 3, is in mesh with drive gear 80 and at its leftmost position in FIG. 3, is disengaged from drive gear 80. The longitudinal direction of slots 26 and 27 is parallel to the direction of movement of rack member 64.

In operation, lateral movement of rack member 64 to the right in FIG. 3 will carry shaft 74 to the right because of the inherent friction of the interengaged gear teeth and the shaft-slot friction in slots 26 and 27. Thus, shaft 74 will move along slots 26 and 27 and cause gear 76 to mesh with drive gear 80. Continued lateral movement of rack member 64 to the right in FIG. 3 will rotate turntable drive gear 80 in a counterclockwise direction to impart rotation to turntable 40. The inertia of the system will maintain the gears in engagement as long as rack member 64 is moving to the right. As soon as rightward movement of rack member 64 ceases, drive gear 80 will continue to rotate due to the rotational inertia of turntable 40, gear 76 will be urged in a clockwise direction by drive gear 80, and the teeth of pinion gear 78 will walk back along rack member 64 in a direction to the left in FIG. 3 to disengage gear 76 from drive gear 80. This disengagement of gear 76 from drive gear 80 permits turntable 40 to continue rotating freely. Retracting movement of rack member 64 to the left in FIG. 3 will rotate pinion gear 78 in a counterclockwise direction, but shaft 74 will remain to the left in slots 26 and 27 to maintain gear 76 disengaged from drive gear 80 until subsequent repeat depression of the dome when the same operation will be repeated.

The operation of top 10 is illustrated in FIG. 1B. Simple downward pressure applied to dome 36 or housing member 22, sufficient to overcome the upward force of springs 18, will cause housing member 22 to move downwardly toward base 12. As housing member 22 approaches base 12, elbow drive 50 is distended and straightened, and rack member 64 is urged toward the right-hand position shown in FIG. 1B. The initial lateral movement of rack member 64 to the right in FIG. 1B will carry escape gear 70 of the drive means into engagement with drive gear 80. Further continuous lateral movement of rack member 64 to the right in FIG. 1B will rotate drive gear 80 in a counterclockwise direction causing rapid rotation of turntable 40. The engaged relationship of escape gear 70 with drive gear 80 will continue as long as rack 64 maintains sufficient lateral motion to keep escape gear 70 engaged with drive gear 80.

When lateral motion to the right in FIG. 1B of rack member 64 has been sufficiently reduced, drive gear 80 will cause escape gear 70 to walk backwards to the left in FIG. 1B along rack member 64. As a result, escape gear 70 will become disengaged from drive gear 80, permitting turntable 40 to rotate freely on bearing 44.

When downward manual pressure on dome 36 or housing member 22 is released, housing member 22 will return to its upper rest position shown in FIG. 1A, in response to upward pressure from springs 18. Return spring 72 will then return rack member 64 to its rest, left-hand position in FIG. 1A, and at the same time cock elbow drive 50. If dome 36 is depressed multiple times with sufficient force and speed while turntable 40 is rotating, additional acceleration of turntable 40 will be obtained.

Dome 36 can be partially decorated or completely transparent. Dome 36 can be formed with a central figure 84, such as a cartoon character, animal, or the like, integrally formed with dome 36 and fixed around central hub 40*a* of turntable 40 as shown in FIG. 1A. Alternatively, central FIG. 84 can be mounted to rotate with turntable 40 by forming character 84 integrally with turntable hub 40*a*. The presence of a central figure thus makes the top even more visually stimulating.

In accordance with a further aspect of the invention, and as illustrated in FIG. 4, a peek-a-boo enclosure 86 is provided for central FIG. 84 comprising a plurality of shroud segments 88 that fit together to substantially cover central FIG. 84. In the illustrated form, each shroud segment 88 is slidably mounted in a slot 92 in turntable 40, and loosely secured to turntable 40 by headed pins, one of which is shown in FIG. 4 as headed pin 90. A single radially extending pin can be used, if desired, to maintain shroud segments 88 for pure radial movement. The headed pins 90 pass through slots 92 in turntable 40 so that as turntable 40 rotates, shroud segments 88 slide radially outwardly along slots 92 on turntable 40. If desired, shroud segments 88 can be provided with weights, one of which is shown in FIG. 4 as weight 94, to accelerate the radial movement of the shroud segments 88 during rotation of turntable 40. Such weights also increase the total inertia of the turntable and increase speed and spin duration.

During rotation of turntable 40 having peek-a-boo enclosure 86, shroud segments 88 are thrown radially outwardly by centrifugal force from their rest position shown in FIG. 1A to the operative position shown in FIG. 1B to reveal the central FIG. 84. This surprising peek-a-boo aspect of the top is especially entertaining to young children, and enhances the overall play value of the toy.

Figure 5:
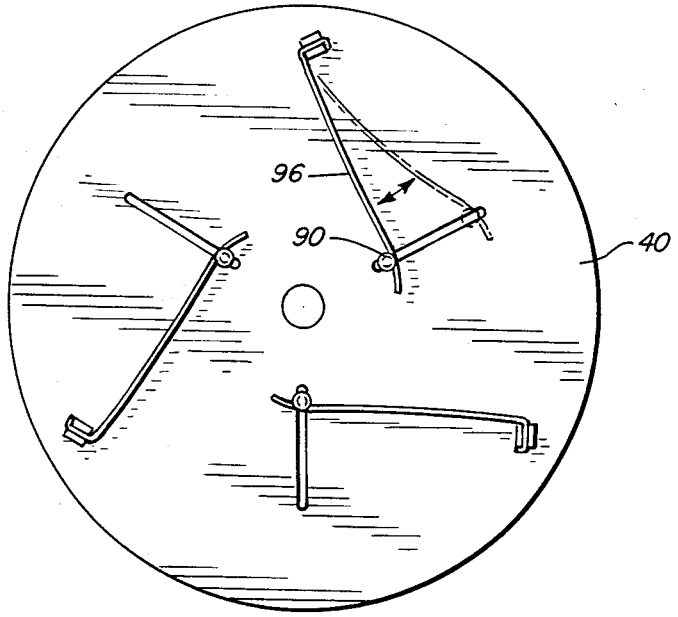
FIG. 5 is a bottom view of the turntable, illustrating the movement of the clip springs during radial movement of the shroud segments in response to centrifugal force from rotation of the turntable.

In order to return the shroud segments 88 to their rest positions when the centrifugal force acting on them has diminished, a plurality of return springs 96 are provided as shown in FIG. 5. In the illustrated form, return springs 96 are shown as clip springs mounted on the lower surface of turntable 40. Springs 96 urge pins 90 toward a radially inward position on turntable 40. In operation, springs 96 bend from a solid line rest position to the dotted line actuated position shown in FIG. 5, as pins 90 move radially outwardly during rotation of turntable 40. When the rotational inertia of turntable 40 has diminished sufficiently, springs 96 resume their solid line positions shown in FIG. 5. Such inward movement of the weights will tend to maintain the top's speed because of the conservation of inertia. Conversely, of course, the initial outward movement of the weighted shroud segments will tend to reduce the velocity, providing additional benefit from pumping the dome several times.

From the foregoing it will be seen that the present invention brings to the art a new and improved spinning top which overcomes many of the drawbacks of conventional spinning tops. Specifically, complex mechanical manipulations are not required to operate the present top, but instead, simple downward pressure on the dome will cause the visual display under the dome to spin rapidly. Thus, the top of the present invention is particularly well suited for use by infants and small children with limited manual dexterity. It will also be noted that during operation of the present top, the base remains stationary relative to its supporting surface so that an infant or small child can be entertained by the toy while remaining seated or confined to a given spot. Moreover, it will be observed that in the present top, the housing member is the only moving part exposed, so that the possibility of body parts getting pinched by moving parts or cut by sharp rotating surfaces is substantially reduced.

While particular embodiments and applications of the present invention have been shown, it will be understood, of course, that the invention is not limited thereto since modifications may be made by those skilled in the art, particularly in light of the foregoing teachings. It is therefore contemplated by the appended claims to cover any such modifications as incorporate those features that come within the true spirit and scope of the invention.

What is claimed is:

1. A spinning top for a generally horizontal support surface comprising:

base means adapted to rest on the surface;

housing means movable relative to said base means, said housing means having diaphanous dome means attached to an upper portion thereof to define a chamber;

resilient compressive means for urging said housing means away from said base means;

rotatable means axially mounted on said housing means within said chamber;

drive means for engaging said rotatable means to impart rotation thereto; and actuating means operatively connected to said drive means, said actuating means acting upon said drive means to engage said drive means with said rotatable means to rotate said rotatable means during movement of said housing means toward said base means, and said actuating means acting upon said drive means to disengage said drive means from said rotatable means to permit said rotatable means to rotate freely in the absence of movement of said housing means toward said base means.

2. A spinning top as defined in claim 1 wherein said actuating means comprises:

a rack member slidably mounted in said housing means for lateral movement, said rack member operatively connected to said drive means;

an elbow drive comprising a first lever arm pivotally connected at its one end to said housing means, and a second lever arm pivotally connected at its one end to the other end of said first lever arm, said second lever arm pivotally connected at its other end to said rack member so that upon movement of said housing means toward said base means said elbow drive is straightened to urge said rack member laterally outwardly to engage said drive means with said rotatable means to rotate said rotatable means;

resilient means operatively associated with said rack member, said resilient means acting upon said rack member to urge said rack member laterally inwardly to disengage said drive means from said rotatable means in the absence of movement of said housing means toward said base means.

3. A spinning top for a generally horizontal support surface comprising:

base means adapted to rest on the surface;

housing means movable relative to said base means, said housing means having diaphanous dome means attached to an upper portion thereof to define a chamber;

resilient compressive means for urging said housing means away from said base means;

rotatable means axially mounted on said housing means within said chamber, said rotatable means having a shaft with a drive gear mounted thereon;

a rack member slidably mounted in said housing means for lateral movement substantially perpendicular to the axis of said shaft of said rotatable means;

an escape gear operatively connected to said rack member, said escape gear having a shaft slidably mounted in slots in said housing means, said slots substantially parallel to said rack member, so that outward lateral movement of said rack urges said escape gear into engagement with said drive gear to rotate said rotatable means;

an elbow drive comprising a first lever arm pivotally connected at its one end to said housing means, and a second lever arm pivotally connected at its one end to the other end of said first lever arm, said second lever arm pivotally connected at its other end to said rack member, so that upon movement of said housing means toward said base means said elbow drive is straightened to urge said rack member laterally outwardly;

resilient means operatively associated with said rack member to urge said rack member laterally inwardly in the absence of movement of said housing means toward said base means to disengage said escape gear from said drive gear to permit said rotatable means to rotate freely.

4. A spinning top for a generally horizontal support surface comprising:

base means adapted to rest on the surface;

housing means movable relative to said base means, said housing means having diaphanous dome means attached to an portion thereof to define a chamber;

resilient compressive means for urging said housing means away from said base means;

rotatable means axially mounted on said housing means within said chamber;

drive means for engaging said rotatable means to impart rotation to said rotatable means;

actuating means operatively connected to said drive means, said actuating means acting upon said drive means to engage said drive means with said rotatable means to rotate said rotatable means during movement of said housing means toward said base means, and said actuating means acting upon said drive means to disengage said drive means from said rotatable means to permit said rotatable means to rotate freely in the absence of movement of said housing means toward said base means;

a central figure disposed within said chamber;

shroud means disposed about said figure, said shroud means comprising a plurality of shroud segments slidably mounted by fastening means along guide slots in said rotatable means for radial movement, so that said shroud segments separate when urged radially outwardly by centrifugal force from the rotation of said rotatable means, and resilient means for urging said shroud segments radially inwardly so that said shroud segments return radially inwardly to shroud said central figure when centrifugal force from the rotation of said rotatable means is insufficient to urge said shroud segments radially outwardly.

5. A spinning top as defined in claim 4 wherein said actuating means comprises:

a rack member slidably mounted in said housing means for lateral movement, said rack member operatively connected to said drive means;

an elbow drive comprising a first lever arm pivotally connected at its one end to said housing means, and a second lever arm pivotally connected at its one end to the other end of said first lever arm, said second lever arm pivotally connected at its other end to said rack member so that upon movement of said housing means toward said base means said elbow drive is straightened to urge said rack member laterally outwardly to engage said drive means with said rotatable means to rotate said rotatable means;

resilient means operatively associated with said rack member, said resilient means acting upon said rack member to urge said rack member laterally inwardly to disengage said drive means from said rotatable means in the absence of movement of said housing means toward said base means.

6. A spinning top as defined in claim 4 wherein said central figure is integrally formed with said dome means.

7. A spinning top as defined in claim 4 wherein said central figure is fixedly mounted on said rotatable means.

8. A spinning top as defined in claim 4 wherein said fastening means comprises pins headed on each end and passing through said guide slots.

9. A spinning top as defined in claim 4 wherein said rotatable means carries a sensually stimulating display.

* * * * *

UNITED STATES PATENT AND TRADEMARK OFFICE

CERTIFICATE OF CORRECTION

PATENT NO. : 4,643,692

DATED : February 17, 1987

INVENTOR(S) : Ronald G. Magers

It is certified that error appears in the above-identified patent and that said Letters Patent is hereby corrected as shown below:

Column 9, line 36 (Claim 4):

change "an portion" to read

-- an upper portion --.

Signed and Sealed this

Eighteenth Day of August, 1987

*Attest:*

DONALD J. QUIGG

*Attesting Officer*

*Commissioner of Patents and Trademarks*